US007174954B1

(12) United States Patent
Schwartz et al.

(10) Patent No.: US 7,174,954 B1
(45) Date of Patent: Feb. 13, 2007

(54) HEAT EXCHANGER

(75) Inventors: Erwin Schwartz, 305 Baffin, Dollard-des-Ormeaux, Que. (CA) H9A 3G4; Peter Lipert, Dollard-des-Ormeaux (CA)

(73) Assignee: Erwin Schwartz, Dollard-des-Ormeaux (CA)

( * ) Notice: Subject to any disclaimer, the term of this patent is extended or adjusted under 35 U.S.C. 154(b) by 0 days.

(21) Appl. No.: 08/418,286

(22) Filed: Apr. 7, 1995

(51) Int. Cl.
*F28F 3/08* (2006.01)

(52) U.S. Cl. ..... 165/166; 165/95

(58) Field of Classification Search ..... 165/169, 165/168, 166, 165, 80.4, 174, 167
See application file for complete search history.

(56) References Cited

U.S. PATENT DOCUMENTS

| | | | | | |
|---|---|---|---|---|---|
| 2,487,584 | A | * | 11/1949 | Patterson | 165/169 |
| 4,023,617 | A | * | 5/1977 | Carlson et al. | 165/169 |
| 4,083,400 | A | * | 4/1978 | Dziedzic et al. | 165/165 |
| 4,141,412 | A | | 2/1979 | Culbertson | 165/166 |
| 4,206,237 | A | * | 6/1980 | Sakata et al. | 165/169 X |
| 4,466,482 | A | * | 8/1984 | Dorazio et al. | 165/174 |
| 4,609,039 | A | * | 9/1986 | Fushiki et al. | 165/174 X |
| 4,614,227 | A | * | 9/1986 | Vogel | 165/80.4 |
| 4,636,283 | A | * | 1/1987 | Nasser | 165/166 X |
| 4,823,867 | A | * | 4/1989 | Pollard et al. | 165/167 X |
| 4,848,450 | A | * | 7/1989 | Lapkowsky | 165/167 X |
| 5,000,253 | A | * | 3/1991 | Komarnicki | 165/166 X |
| 5,069,276 | A | * | 12/1991 | Seidel | 165/167 X |
| 5,078,208 | A | * | 1/1992 | Urch | 165/166 |
| 5,098,514 | A | * | 3/1992 | Held | 165/168 X |
| 5,111,878 | A | * | 5/1992 | Kadle | 165/174 X |
| 5,323,851 | A | * | 6/1994 | Abraham | 165/174 |

FOREIGN PATENT DOCUMENTS

| | | | | |
|---|---|---|---|---|
| CA | 1134809 | | 11/1982 | 257/14 |
| CA | 1166630 | | 5/1984 | 257/11 |
| CA | 1309708 | | 4/1985 | 257/11 |
| CA | 0587971 | * | 12/1989 | 165/80.4 |
| CA | 2014610 | | 10/1990 | 257/11 |
| CA | 2032314 | | 12/1990 | 257/14 |
| CA | 2039020 | | 3/1991 | 257/14 |
| JP | 0306097 | * | 12/1990 | 165/80.4 |

* cited by examiner

*Primary Examiner*—Leonard R. Leo

(57) ABSTRACT

The present invention relates to a heat exchanger comprising a plurality of parallel-oriented plates or layers securely fixed between two outer walls or frames to define between adjacent plates an area of sealed passages for two heat exchanging fluids, channel or duct means for conducting a hot medium and a cold medium respectively over the layers such that the flow of hot and cold medium takes place in an in-line and a counter-flow fashion, and an external return bend means providing a transfer of the respective medium from one layer to another. Each of the channel means are defined by a pair of layers disposed one next to the other, by straight or directional baffle means, and an internal return bend means located between the adjacent layers. The internal return bend means have a configuration allowing direct access to the channel means at at least one end without the necessity to dismantle the entire heat exchanger unit, and the outer walls or frames of the heat exchanger form a permanently fixed rigid structure to provide a liquid-tight enclosure. The external return bend means have a predetermined configuration adapted to provide a greater flow turbulence of the fluid passing through each of the channels.

17 Claims, 14 Drawing Sheets

HEAT EXCHANGER

The present invention relates to an apparatus for heat exchanger between different liquid media, such as hot digested sludge and raw cold sludge in pulp and paper industry, or in the dairy or any other industry which uses other liquids that contain particles of solid material There is known CP 1,309,708 related to a heat exchanger comprising a plurality of parallel sheets, duct means for conducting hot and cold flows of liquids in cross and counter-flow fashion. The exchanger is kept in a operable position by means of clamping elements and is provided with four doors for cleaning duct means.

There is also known CP 1,134,809 related to a plate heat exchanger comprising a plurality of parallel plates to define a series of sealed passages, most of which being bounded on opposite sides thereof by plates, but at least one of said passages being bounded by plate only one side.

There is also known U.S. Pat. No. 4,141,412 related to a heat recuperating unit comprising a plurality of spaced sheets, spacers are installed between said sheets and splitters are mounted between adjacent channels for guiding the air flow. The unit has a modular configuration and is provided with internal and external returns which are inside of said unit, all four sides of which are clamped together.

SUMMARY OF THE INVENTION

Broadly, the present invention comprises a heat exchanger comprising:

a plurality of parallel-oriented plates or layers securely fixed between two outer walls or frames to define between adjacent plates an area of sealed passages for two heat exchanging fluids, channel or duct means for conducting a hot medium and a cold medium respectively over the layers such that the flow of hot and cold medium takes place in an in-line and a counter-flow fashion;

an external return bend means providing a transfer of the respective medium from one layer to another layer;

each of said channel means being defined by a pair of said layers disposed one next to the other and by straight or directional baffle means and an internal return bend means located between said adjacent layers, said internal return bend means having a configuration allowing direct access to said channel means at least at one end without the necessity to dismantle the entire heat exchanger unit;

wherein said outer walls or frames, said heat exchanger is forming a permanently fixed rigid structure to provide a liquid-tight enclosure; and wherein said external return bend means having a predetermined configuration adapted to provide a greater flow turbulence of the fluid passing through each of said channels.

In another embodiment of the present invention, said internal return bends having a predetermined configuration adapted to provide a greater flow turbulence of the fluid passing through each of said channels, and said heat exchanger further comprising at least one cleaning door which is removably engaged in an air and liquid tight fashion to allow accessibility for cleaning without dismantling of the entire unit. Said heat exchanger further comprising two cleaning doors which are removably engaged in an air and liquid tight fashion to allow accessibility simultaneously from two opposite directions without dismantling the entire unit, and said inner return bend means are permanently fixed between said adjacent sheets to provide liquid-tight conditions under high pressure.

In yet another embodiment, said outer walls or frames, said layers, said directional baffle means and said internal return bend means are fixed to each other by means of seal-welding, and said heat exchanger further comprising an inlet pipe means and an outlet pipe means provided for conducting of said hot and cold fluids. Said inlet and outlet pipe means located adjacent to the outer walls or frames to allow easy removal of said doors, and said inner return bend means are removably attached between said adjacent sheets to facilitate easy accessibility for cleaning of said channel means.

In still another embodiment, said inner return bend means are permanently fixed at one end of said channel means and are removably attached on the opposite end of said channel means, and each of said directional baffle means is provided with a rounded off ends in order to avoid snagging stringy material contained in said passing fluid. Said external and internal return bend means have in cross-section a semi-hexagonal configuration, or said internal return bend means have in cross-section a semi-octagonal configuration. In other variations, said internal return bend means have in cross-section a semi-circular corrugated-rib configuration or a semi-circular configuration. Said external return bend means have in cross-section a symmetrical step-like configuration, and said directional baffle means are provided with a plurality of a pressure relieve recesses formed on said baffle means to allow a quick distribution of pressure in said channel means and to avoid a one-side pressure on said baffle means during the plugging of said channel means.

In yet another embodiment of the present invention, said internal return bend means are attached to inner surfaces of said doors to provide easy cleaning of said heat exchanger, and wherein said heat exchanger further comprises a transition means adapted to connect said inlet and outlet pipe means with said heat exchanger. The plurality of said parallel layer means are oriented horizontally or vertically.

DESCRIPTION OF THE PREFERRED EMBODIMENT OF THE INVENTION

Figure 1:
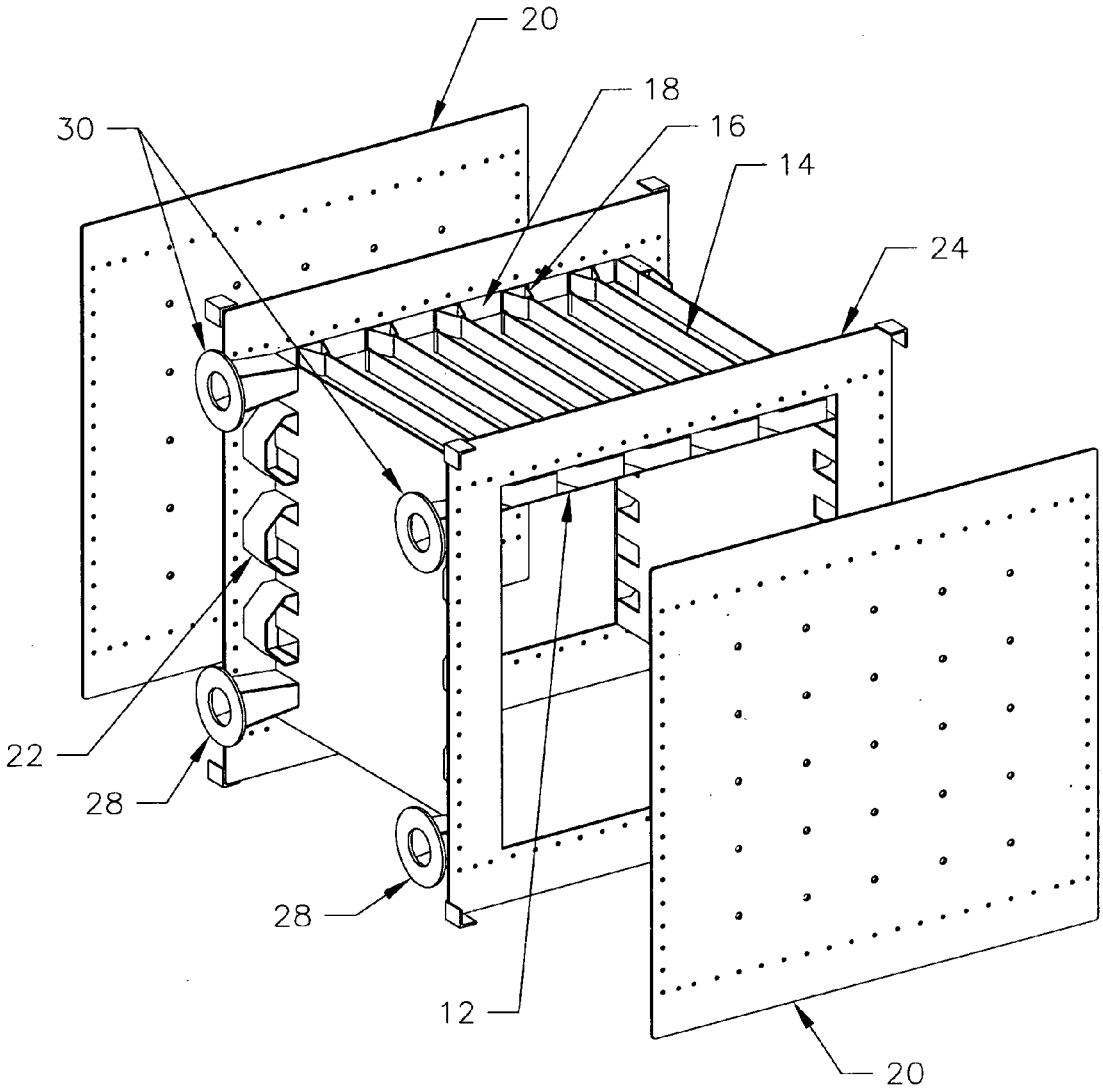
FIG. 1 shows a perspective dis-assembled view of the heat exchanger according to the present invention in which only upper heat exchanger sheet is shown.

Referring now to the drawings wherein like reference numerals designate like parts, and with particular reference to FIG. 1. there is shown a heat exchanger generally designated by the numeral 10 comprising a plurality of spaced heat exchange sheets or layers permanently fixed between two side walls or frames 26. Preferably, but not necessary those plurality of sheets are spaces in horizontal plane. However, the same plurality of sheets may be spaced in vertical plane without departing from the spirit of the present invention. Those plurality of parallel-oriented sheets or plates or layers 12 are defining between adjacent sheets an area of sealed passages for two heat exchange fluids and is provided with duct or channel means for conducting a hot medium and a cold medium respectively over the sheets 12 such that the flow of hot and cold medium takes place in an inline and counter-flow fashion. Such arrangement of inflow and counter-flow allows to provide more efficient heat transfer then cross and counter-flow of the known designs. Each of said channel or duct means being defined by a straight or directional baffle means 14 and an internal return bend means comprising return wedges 16 and internal return bends 18. As it was mentioned above, the device uses inline and counter flow of liquid in between each layer which is sequentially repeated every few layers. The principle operation of the device is the heat exchange between hot and cold media. It could be different liquids (sludge and clean water) or the same liquid, wherein those liquids flow through series of separate flat or corrugated (not shown) plates or sheets 12. Each adjacent layer is of different temperature, i.e. cold layer between two hot layers or hot layer between two cold layers (except the top and bottom layers).

Figure 2:
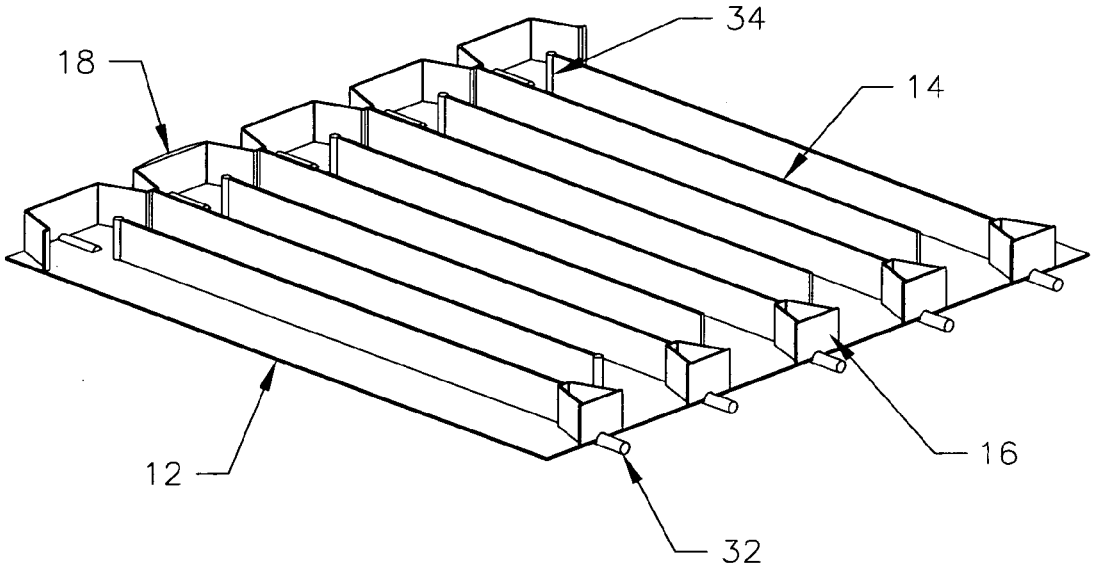
FIG. 2 shows a perspective view of one of the typical heat exchange layers with directional baffles, optional internal bolts and internal return bends according to the first modification of the present invention.
Figure 3:
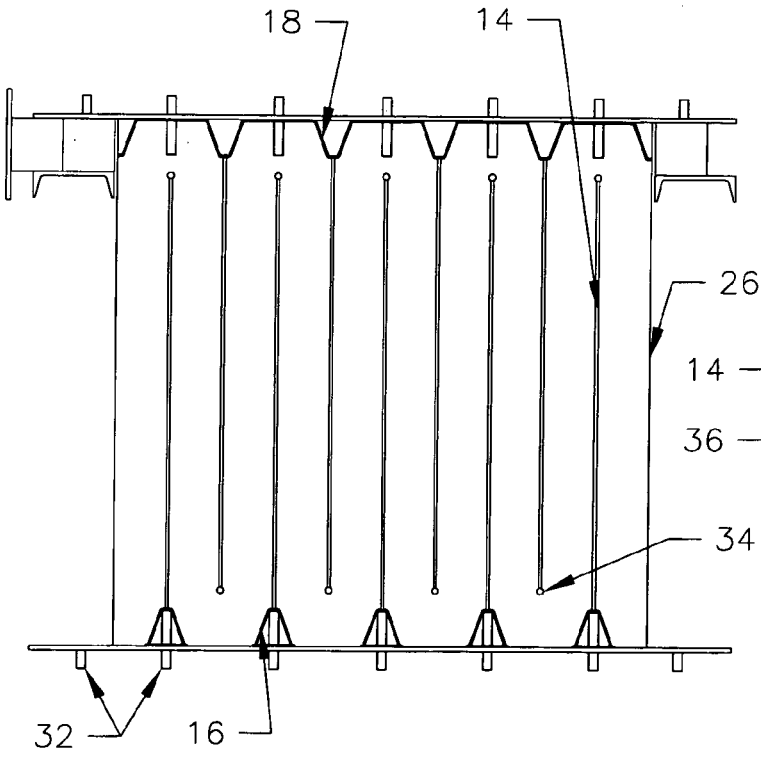
FIG. 3 shows a top view of the upper heat exchange sheet of FIG. 1.

A front and rear doors 20 are bolted or clamped to the unit 10 using flange bolts (not shown) and optional intermediate studs 32 (see FIG. 2) that are welded to some of the horizontal layers 12. Those doors 20 are removable and are provided for easy cleaning of every channel without dismantling the entire structure. It is very important that the doors 20 are adapted to be removably engaged to the unit 10 in air and liquid tight fashion to allow accessibility for cleaning simultaneously from two opposite sides upon opening or removal of said doors, or individually from one side only. In another embodiment (not shown) doors could be without central holes for bolts, but being structurally reinforced.

In case when all internal return bends are removable from the same side, it is possible to have only one removable door, which is very advantageous feature of this arrangement.

When one media comprises water for heating or cooling, only the opposite side with liquid containing solids has to have access door.

Figure 20:
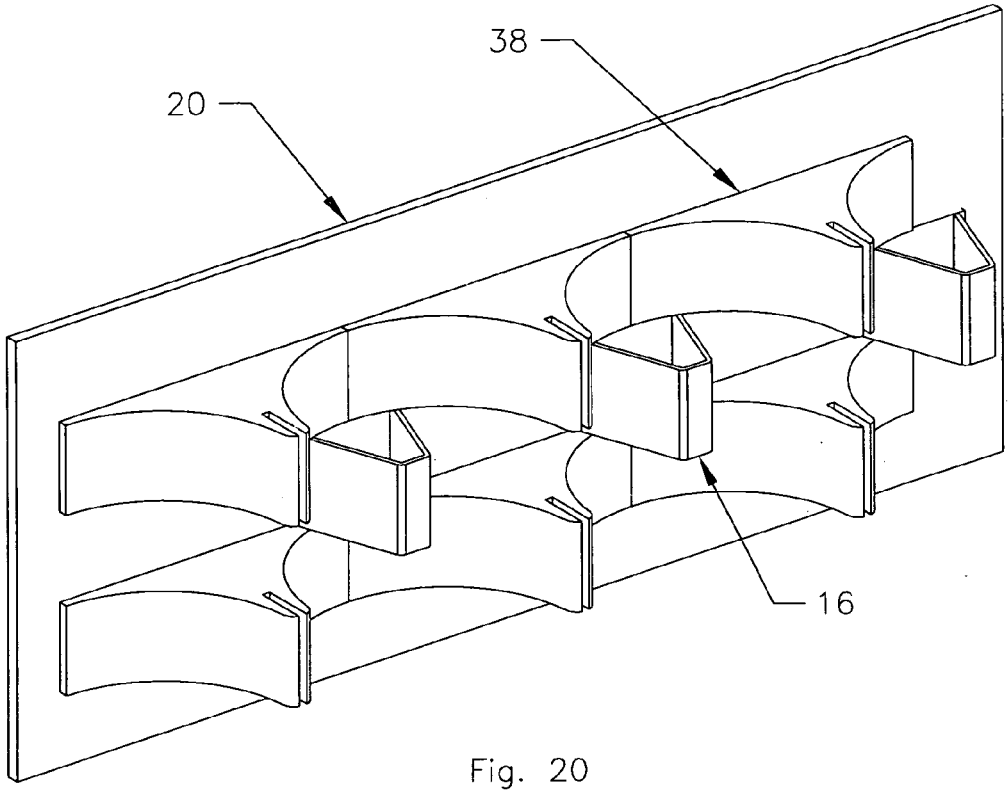
FIG. 20 shows a fragmental perspective view of third modification of internal return bends and wedges incorporated onto the inner surface of the door.

This cleaning operation is facilitated by means of special configuration of return wedges 16 which are specially designed to allow unrestricted access to each channel when the doors 20 are opened or removed (see FIG. 2), which is very important feature of the present invention. In the other modification the doors 20 could be of a swing-type structure or clamped or pull-back (not shown) which also permits see through inspection, particularly in case, when internal return bends are removable (see FIG. 8) or when those bends are fixed permanently to the inner surface of the doors 20 (see FIG. 20). The substantial advantage of the present invention in having only two doors instead of four (as in the prior art structures) lies in the fact of faster accessibility to the internal bends, more solid general structure, fewer gaskets and bolts, and thus, less risk of leaks, possibility of higher operating pressure. It is also one of the important features of the present invention, that horizontal sheets or layers 12 may be welded to the side walls 26 to form a part of the rigid structure. In the first embodiment shown on FIG. 1 internal return bends 18 and return wedges 16 are also welded between sheets 12, allowing to use the unit 10 under very high pressure in an air and liquid tight fashion. Each door 20 is also provided with a gasket (not shown) that eliminates leakages.

Figure 11:
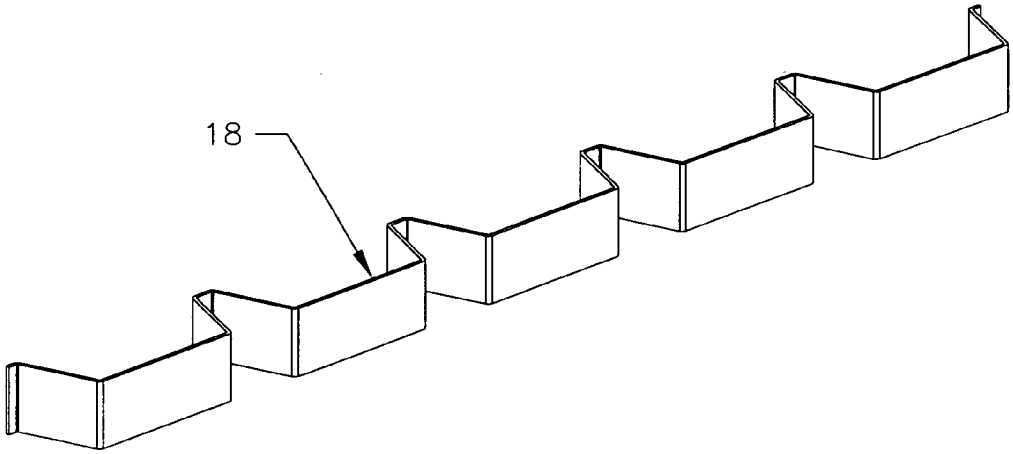
FIG. 11 shows a perspective view of the internal return bends of FIG. 1.
Figure 13:
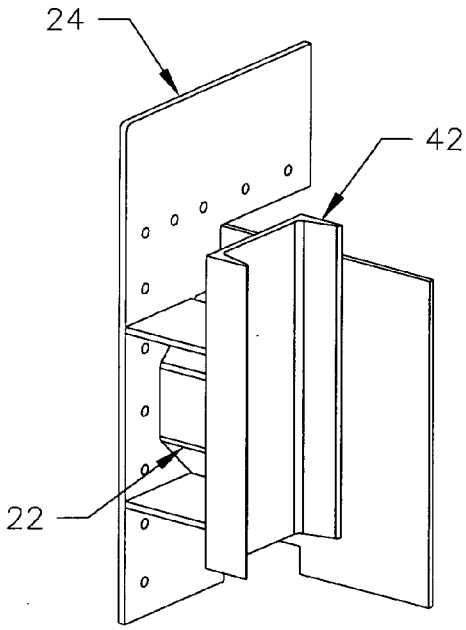
FIG. 13 shows a perspective view of FIG. 12 turned under 90 degrees.
Figure 14:
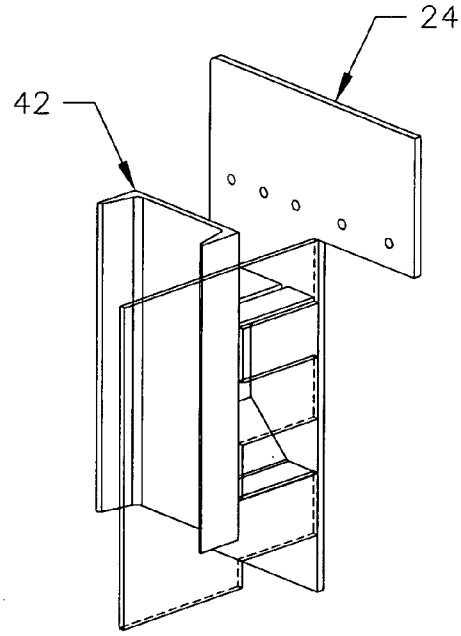
FIG. 14 shows a perspective view of FIG. 13 turned under 90 degrees.
Figure 12:
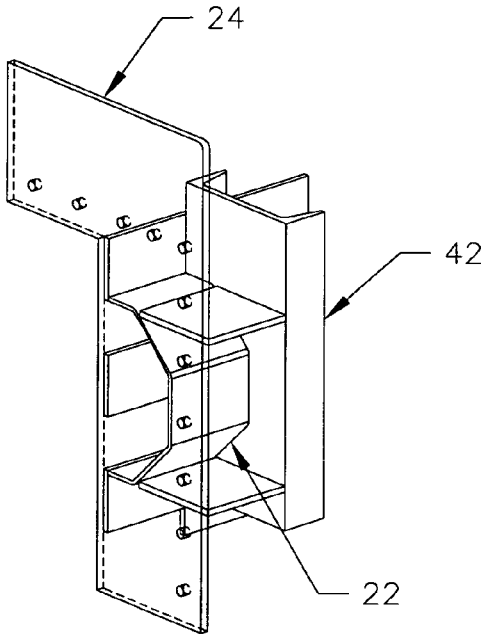
FIG. 12 shows a partial perspective view of FIG. 1 depicting an semi-hexagonal shaped external return bend according to the fist modification.
Figure 17:
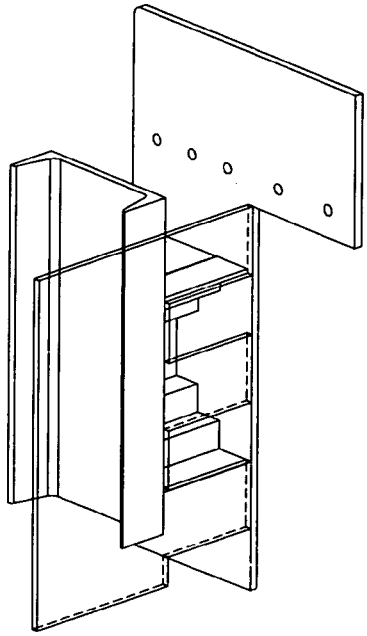
FIG. 17 shows a perspective view of FIG. 16 turned under 90 degrees.
Figure 16:
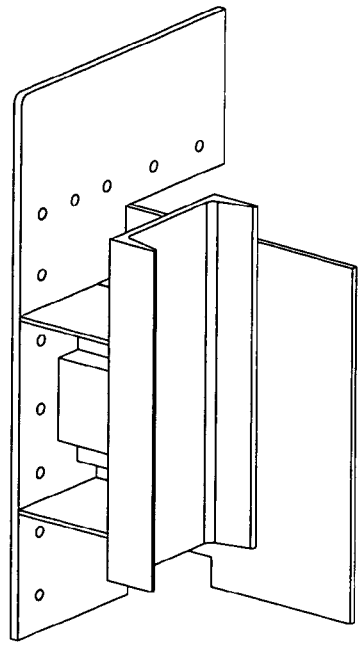
FIG. 16 shows a perspective view of FIG. 15 turned under 90 degrees.

The layers or sheets 12 conducting the same media are connected in series by means of external return bends 22 (see FIGS. 12 and 15) or incorporated internally (not shown), which are providing a transfer of the respective media from one sheet or layer to another sheet or layer. Those external return bends 22 form part of the sides and are incorporated or encompassed between flanges 24 and structural C-channels 42. Those external bends are also seal welded to form a part of rigid structure. External return bends 22 connect every other layer and are located in the sides of the unit 10 which permits easy removal of doors 20 during cleaning operation. Those internal bends may be of different configuration, for example, FIG. 11 shows external return bends of hexagonal configuration and FIG. 12 shows external return bends of symmetrical step-like configuration. All even layers are interconnected in series as well as all odd layers are connected in series by means of external return bends 22. Every second layer is repeated allowing for a modular system of layers. All layers modular and are identical except that they are rotated 180 degree rotation.

Figure 21:
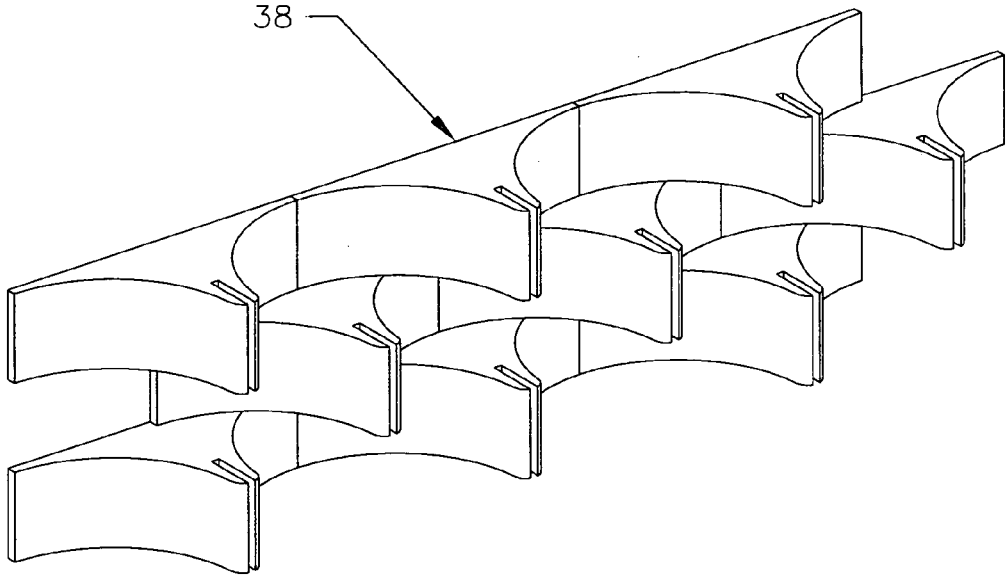
FIG. 21 shows a fragmental perspective view of removable internal return bends of continuous type.
Figure 22:
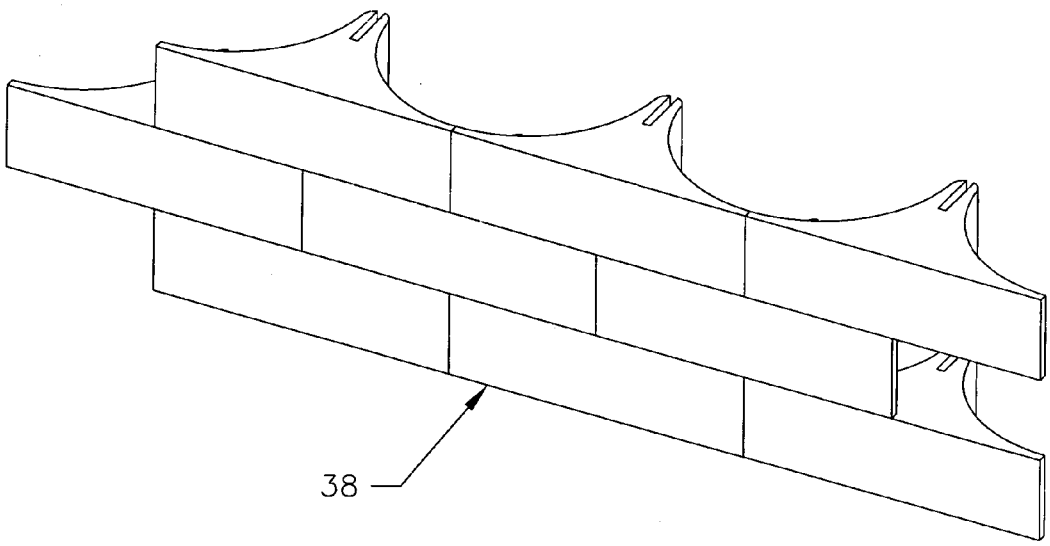
FIG. 22 shows a perspective view of FIG. 21 turned under 90 degrees.
Figure 23:
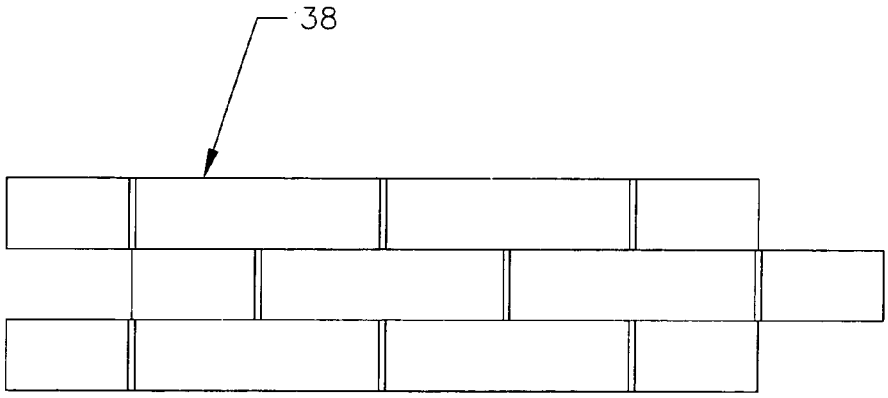
FIG. 23 shows a back view of FIG. 21.

The type and thickness of the constructional materials and sizes of channels permits passage of large and bulky liquid containing solids without plugging, but still providing optimum heat transfer recovery. Present invention provides channel sizing according to media selected. In the same heat exchanger each media could have different channel dimensions, which is an advantage of present invention. The device is fitted with an outlet pipe connections 28 and an inlet pipe connections 30 incorporated at the side walls 26 of the unit in order to have the front and back doors 20 to be easily removable with less connections to separate when needed to clean inside channels. This is another beneficial feature of the present invention. FIG. 1 shows internal return bend 18 which are seal-welded to the upper and lower horizontal layers or sheets 12. However the oppositely located return wedges 16 may be either permanently fixed between sheets 12 as shown on FIG. 1 (when operating under very high pressure), or permanently fixed to the inner surface of the door 20 (see FIG. 21). In both cases it is easy to get access for maintenance. Such configuration of the internal return bend means allows cleaning of each channel and still provides an excellent directional guide to the flow by reducing pressure loss at the 180 degree turns. Besides, the arrangement of horizontal layers being seal-welded to the internal return bends 18 on one side only and the use of the gasketed door 20 creates water tight enclosure wherein no hot or cold liquid can come in contact with each other, since odd layers are welded on one side and the even layers are welded on the opposite side. As it better seen on FIG. 2, the directional baffles 14 are provided with a rounded off ends 34 having a diameter greater than the thickness of said directional baffles 14 in order to avoid hang up of stringy material, which could block the internal bends. Those rounded ends could be attached to the end of each directional baffle 14 or form part of it.

Figure 15:
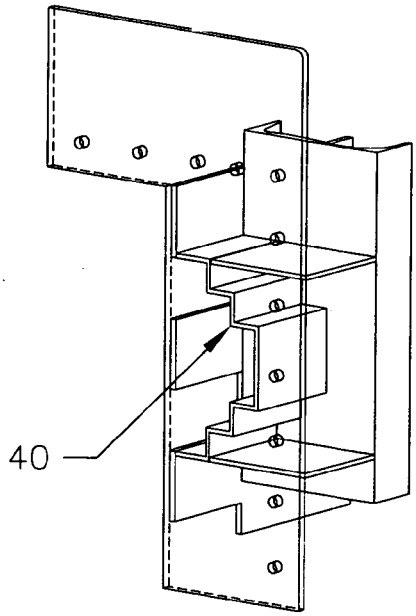
FIG. 15 shows a perspective view of the external return bend according second modification.
Figure 27:
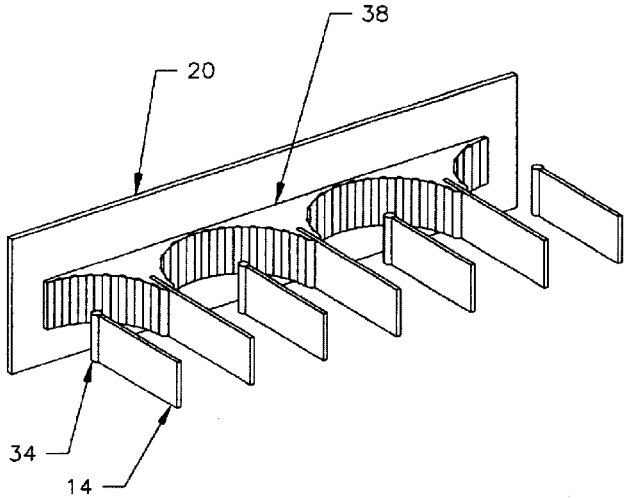
FIG. 27 shows a perspective view of a fragment of the internal return bend of semi-circular corrugated shape.
Figure 28:
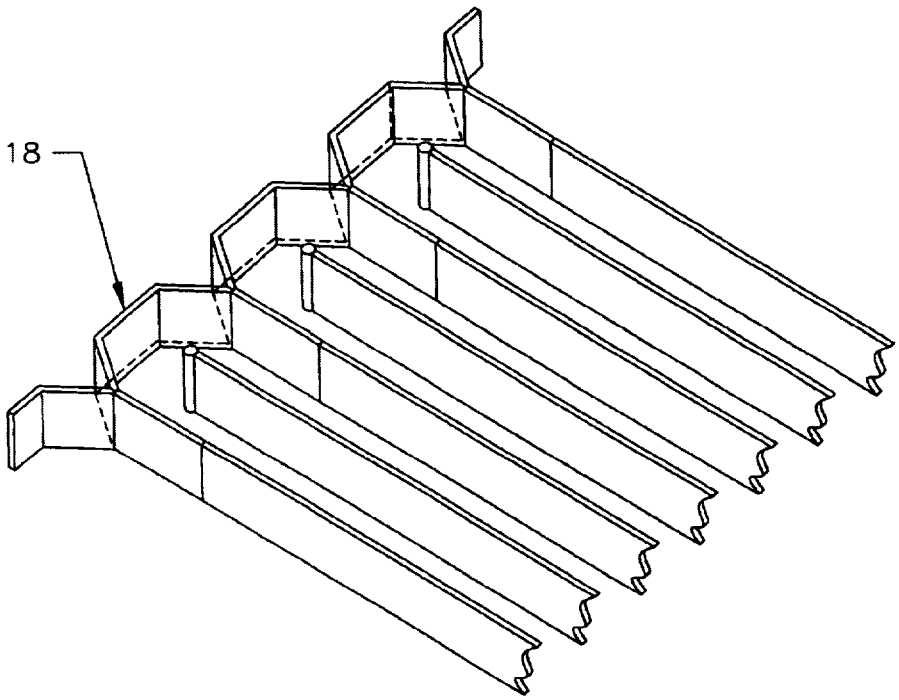
FIG. 28 shows a partial perspective view of the internal return bend of semi-octagonal shape.

One of the most important feature of the present invention is the configuration of internal return bends 18 and external return bends 22. The main advantage of such configuration is provided to create greater turbulence of the passing liquid which is very desirable in the improving the process of heat transfer. FIG. 1 shows the configuration of internal return bends 18, return wedges 16 and external return bends 22 having a semi-hexagonal shape in cross-section. FIG. 15 shows configuration of the external return bends having semi-circular corrugated ribs (under 90 degree) configuration. In other modifications, the internal return bends 18 may have semi-octagonal or corrugated semi-circular corrugated ribs configuration as shown on FIGS. 28 and 27 respectively. Any of those configurations provide the increase of the flow turbulence and provide directional flow at the 180 degree returns.

Figure 8:
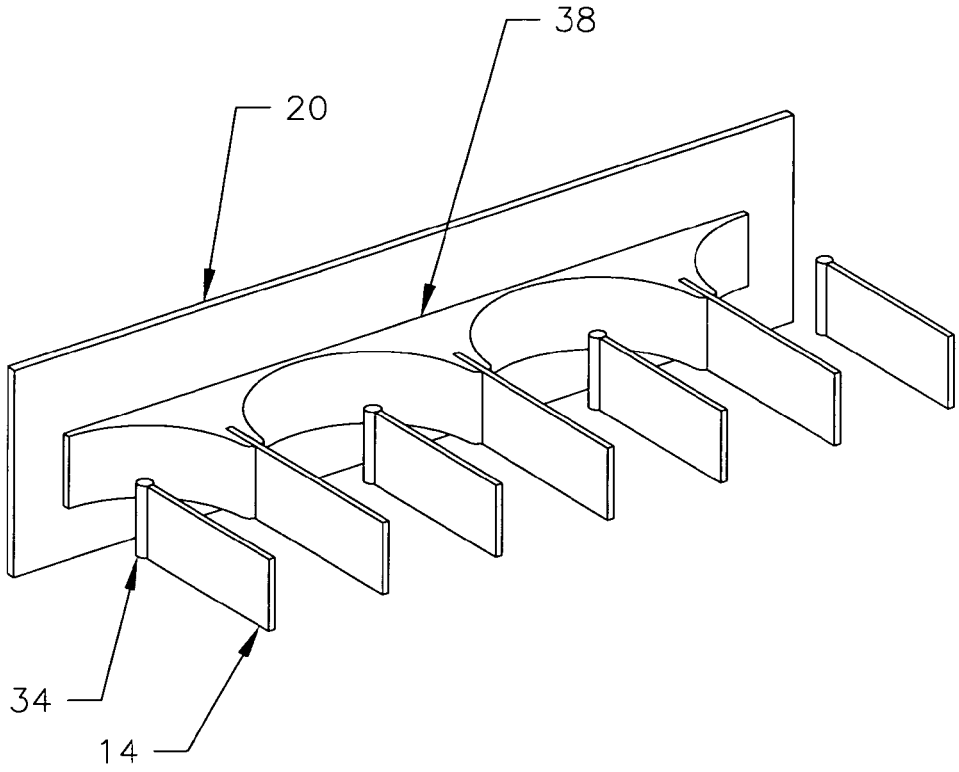
FIG. 8 shows a perspective partial view of the second modification comprising removable moulded internal return bends of semi-circular configuration.
Figure 9:
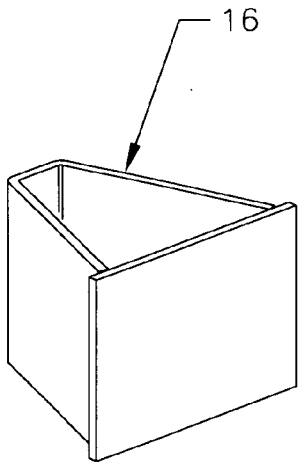
FIG. 9 shows a perspective front view of the return wedge of FIG. 1.
Figure 10:
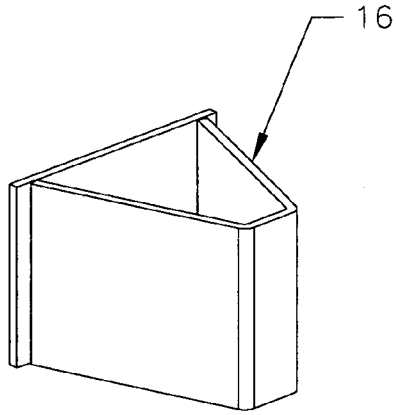
FIG. 10 shows a perspective back view of FIG. 9.
Figure 24:
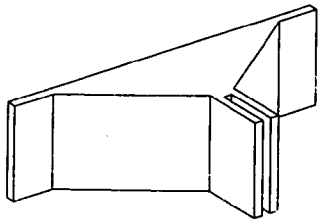
FIG. 24 shows a perspective view of fragment of the removable internal bend of semi-hexagonal shape.
Figure 25:
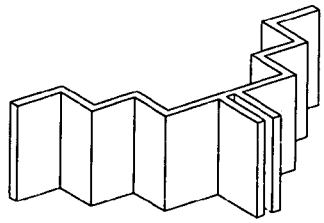
FIG. 25 shows a perspective view of fragment of the removable internal bend of step-like configuration.
Figure 26:
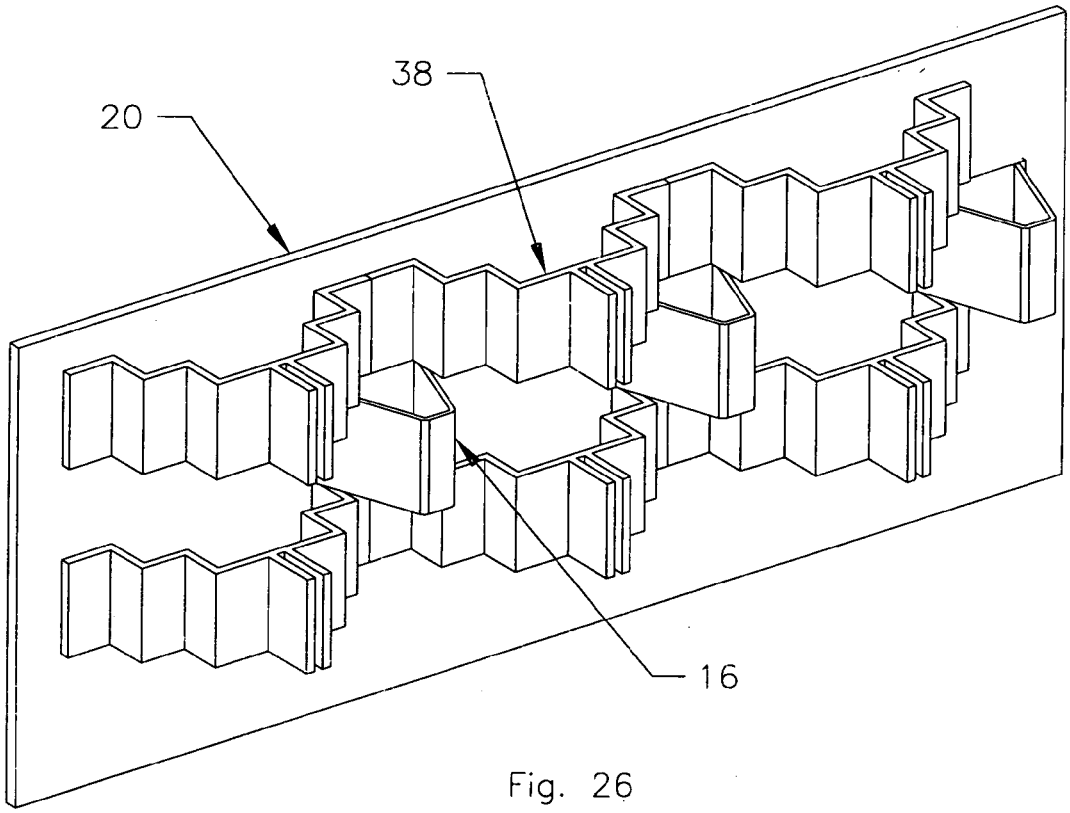
FIG. 26 shows a perspective view on the inside door surface provided with continuous internal return bend of step-like configuration.

As it shown on FIG. 8 internal return bends 38 could be removable and made of moulded plastic. In this case each bend could be an individual part (see FIGS. 24 and 25) or a continues bend (see FIG. 8). Those removable return bends 38 could be made in various materials, such as mild steel or stainless plates, polyethylene or polyurethane molds to fit. As it seen on FIG. 8, moulded bends 38 are interlocked with the corresponding directional baffles 14 to facilitate air and liquid tight passages. In the same time those removable bends 38 could be removed for cleaning channels. FIG. 26 shows another modification of the configuration of the internal return bend having a semi-circular step-like shape. Those bends are continuous and are permanently fixed to the inner surface of the door 20 in the same manner as shown on FIG. 20. Another advantage of the present invention is the fact that the structural design permits expansion due to temperature differential, which is accomplished by means of the horizontal layers or sheets 12 being welded to the vertical side walls 26 which allow harmonious expansion with the expansion of the frame.

Figure 6:
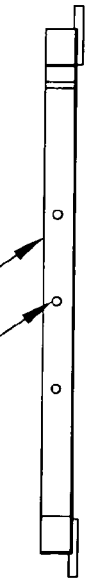
FIG. 6 shows a side view of directional baffle having a number of pressure relieve holes.
Figure 7:
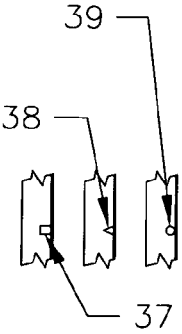
FIG. 7 shows three other modifications of the configurations of pressure relieve holes.
Figure 4:
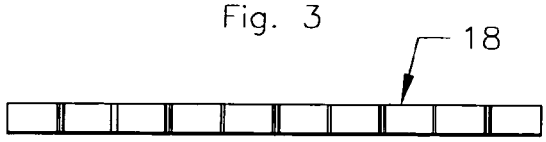
FIG. 4 shows a front view of FIG. 3.
Figure 5:
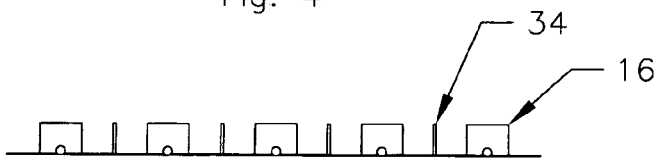
FIG. 5 shows a back view of FIG. 3 with internal return wedges allowing easy access for cleaning between channels.
Figure 18:
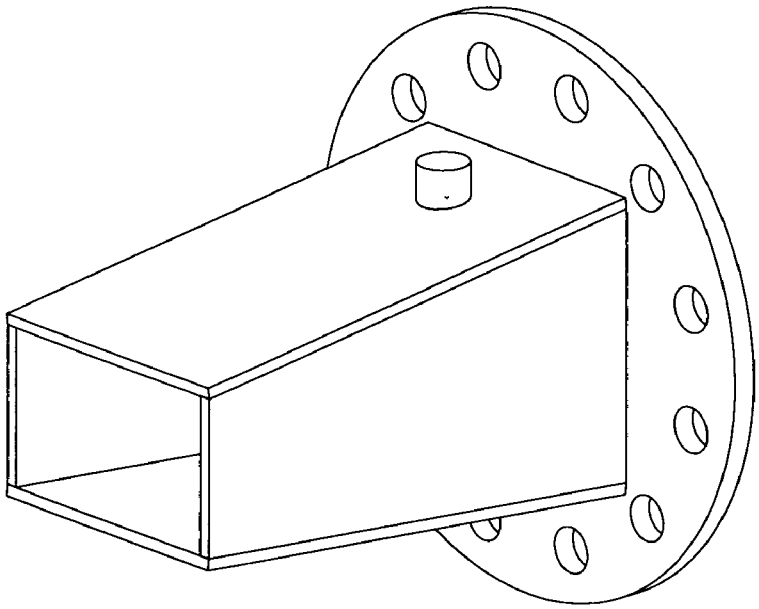
FIG. 18 shows a perspective view of inlet/ pipe connection according the present invention.
Figure 19:
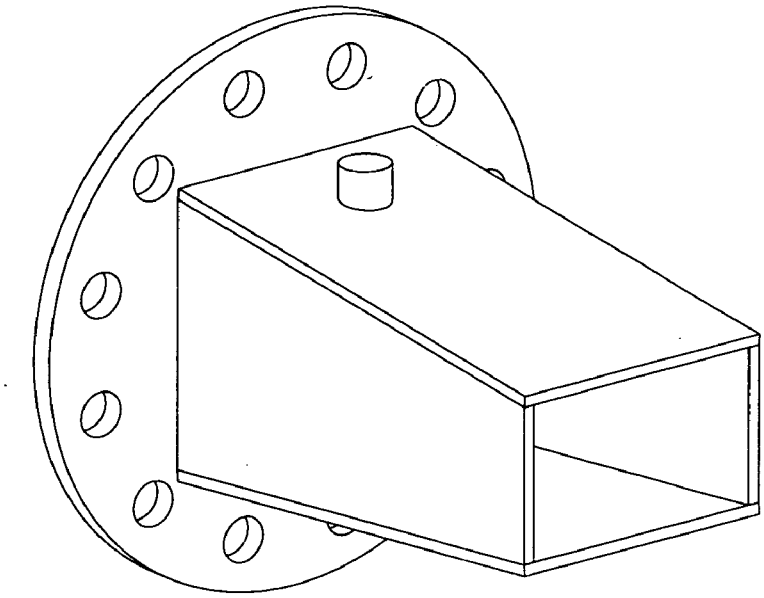
FIG. 19 shows a perspective view of FIG. 18 turned under 90 degrees.
Figure 29:
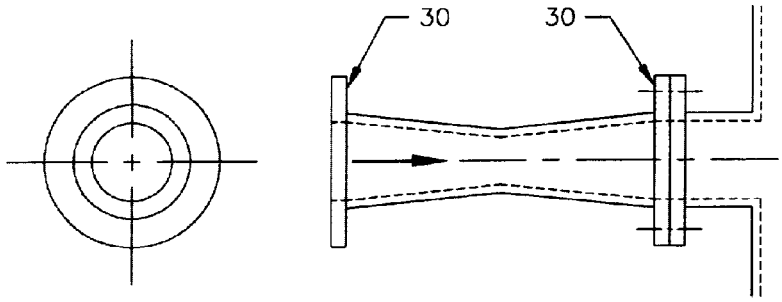
FIG. 29 shows a transitional means at the inlet pipe connection.

Since the channels for conducting liquid having a rectangular configuration, the unit according to the present invention has a specially designed transition connection 28 and 30 (see FIGS. 18, 19 and 29) of the piping from outside round piping to the size of the internal rectangular channel. The advantage of such configuration will prevent plugging inside of the heat exchanger. Both inlets and outlets are on the same side, which require less space for the installation of the unit. Another feature of the present invention is the fact that the unit is provided with a pressure relieve mechanism in the directional baffles 14 by means of pressure relieve recesses or holes 36 to 39 (see FIGS. 6 and 7). Those holes 36 to 39 may be of different configuration and allow a quick distribution of pressure in the channels and also avoid side pressure on the vertical directional baffles 14 in case of plugging of the channels.

The heat exchanger according to the present invention could be manufactured in different sizes to fit applications according to the type of the media, flow capacity and heat transfer requirements. The application of the unit includes heating and cooling of two medias such as:

pulp & pulp;

pulp & water in the pulp and paper industry;

liquids containing solid materials, such as supernatant from digesters or dewatering equipment in waste, sludge or water treatment facilities;

pasteurization of liquid foods.

In general the structure of the heat exchanger according to the present invention allows overall reduction of weight, easy access for maintenance from both sides, improved heat transfer efficiency, adaptability for high pressure, elimination of internal plugging of heat exchange channels or bends, special seal for non-leak operation.

The above-described embodiments should be considered as examples only, and it should be realized that other embodiments are possible within the scope of the following claims.

The invention claimed is:

1. A heat exchanger comprising:

a plurality of parallel-oriented plates securely fixed between two outer walls to define between adjacent plates an area of sealed interleaved passages for two heat exchanging media, a plurality of channel means for conducting a hot medium and a cold medium such that a flow of hot and cold media takes place in an in-line and counter-flow fashion, each of said channel means being defined by directional baffle means and an internal return bend means located between said adjacent plates, said internal return bend means being removably configured to allow direct access to said channel means at at least one end;

an external return bend means providing a transfer of the respective medium from one of said channel means to another of said channel means, said external return bend means being configured to provide a greater flow turbulence of the medium passing through each of said channel means, said external return bend means being incorporated into and extending outwardly from said outer walls;

said outer walls and said plates are permanently fixed to provide a liquid-tight enclosure;

two access doors configured to be removably engaged in an air and liquid tight fashion to allow accessibility simultaneously from said at least one end, said doors being of substantially flat configuration;

wherein said external return bend means are adjacent to said doors; and wherein each of said directional baffle means is provided with rounded off ends having a diameter greater than the thickness of said directional baffle means in order to avoid snagging stringy material contained in said medium.

2. Heat exchanger according to claim 1, wherein said internal return bend means is configured to provide a greater flow turbulence of the respective medium passing through each of said channel means.

3. Heat exchanger according to claim 2, wherein said internal return bend means having in cross-section a semi-hexagonal configuration.

4. Heat exchanger according to claim 2, wherein said internal return bend means having in cross-section a semi-octagonal configuration.

5. Heat exchanger according to claim 2, wherein said internal return bend means having in cross-section a semi-circular corrugated-rib configuration.

6. Heat exchanger according to claim 2, wherein said internal return bend means having in cross-section a semi-circular configuration.

7. Heat exchanger according to claim 1, wherein said outer walls, said plates, and said directional baffle means are fixed to each other by means of seal-welding.

8. Heat exchanger according to claim 1, wherein said heat exchanger further comprising an inlet pipe means and an outlet pipe means provided for conducting of said hot and cold media.

9. Heat exchanger according to claim 8, wherein said inlet and outlet pipe means are located adjacent to the outer walls to allow easy removal of said doors.

10. Heat exchanger according to claim 1, wherein said internal return bend means are permanently fixed at one end of said channel means and are removably attached on the opposite end of said channel means.

11. Heat exchanger according to claim 1, wherein said external return bend means having in cross-section a semi-hexagonal configuration.

12. Heat exchanger according to claim 1, wherein said external return bend means having in cross-section a symmetrical step-like configuration.

13. Heat exchanger according to claim 1, wherein a plurality of pressure relieve holes are formed on said directional baffle means to allow a quick distribution of pressure in said channel means and to avoid a one-side pressure on said directional baffle means during blockage of said channel means.

14. Heat exchanger according to claim 1, wherein said internal return bend means are permanently fixed to inner surfaces of said doors to provide easy cleaning of said heat exchanger.

15. Heat exchanger according to claim 1, wherein said heat exchanger further comprising a transition means connected to said inlet and outlet pipe means.

16. Heat exchanger according to claim 1, wherein the plurality of said parallel-oriented plates are oriented horizontally.

17. Heat exchanger according to claim 1, wherein the plurality of said parallel-oriented plates are oriented vertically.

* * * * *